US010165811B2

(12) United States Patent
O'Leary

(10) Patent No.: US 10,165,811 B2
(45) Date of Patent: Jan. 1, 2019

(54) INTERCHANGEABLE FABRIC ACCESSORY AND METHOD OF USE

(71) Applicant: The Cozmix Inc., Toronto (CA)

(72) Inventor: Brennan John O'Leary, Toronto (CA)

(73) Assignee: The Cozmix Inc., Toronto (CA)

( * ) Notice: Subject to any disclaimer, the term of this patent is extended or adjusted under 35 U.S.C. 154(b) by 1042 days.

(21) Appl. No.: 14/366,270

(22) PCT Filed: Jan. 10, 2013

(86) PCT No.: PCT/CA2013/000032

§ 371 (c)(1),
(2) Date: Jun. 18, 2014

(87) PCT Pub. No.: WO2013/110169

PCT Pub. Date: Aug. 1, 2013

(65) Prior Publication Data

US 2014/0359919 A1 Dec. 11, 2014

Related U.S. Application Data

(60) Provisional application No. 61/591,288, filed on Jan. 27, 2012.

(51) Int. Cl.

| | |
|---|---|
| ***A44B 17/00*** | (2006.01) |
| ***A41D 27/08*** | (2006.01) |
| ***A44C 3/00*** | (2006.01) |

(52) U.S. Cl.

CPC ..... *A41D 27/08* (2013.01); *A44C 3/001* (2013.01)

(58) Field of Classification Search

CPC ... A41D 27/08; A44C 3/001; Y10T 24/44034; Y10T 24/3698; Y10T 24/3651; Y10T 24/13

See application file for complete search history.

(56) References Cited

U.S. PATENT DOCUMENTS

| | | | | | |
|---|---|---|---|---|---|
| 613,723 | A | * | 11/1898 | Richardson | A44C 3/001 40/1.5 |
| 712,622 | A | * | 11/1902 | Traut | A44B 17/0011 16/4 |
| 1,111,452 | A | * | 9/1914 | Fox | A44B 1/00 24/113 R |
| 2,199,148 | A | * | 4/1940 | Farnham | A41F 1/00 24/110 |

(Continued)

*Primary Examiner* — Jason W San
(74) *Attorney, Agent, or Firm* — Blake, Cassels & Graydon LLP; Brett J. Slaney; Santosh K. Chari

(57) ABSTRACT

Interchangeable accessory for removable attachment to garments including attachment and interchangeable sections. The attachment section formed by an inner peripheral ring with interspersed inner and outer ridges, an outer peripheral ring with concavity at an inner-edge surface, and a gap between the outer peripheral ring and the inner peripheral ring for interference fitting. The interchangeable section being a plug with inside and outside peripheral edges which form a cylindrical extension from the plug surface, the inside peripheral edge configured to snap-fit onto the inner ridges, and a cap including an inner circumferential tab having an inner periphery dimensioned smaller than the outer peripheral edge of the plug such that the cap is connectable to the plug in a removable manner.

12 Claims, 2 Drawing Sheets

(56) References Cited

U.S. PATENT DOCUMENTS 2,235,168 A * 3/1941 Reiter ..... A44B 17/0011 24/674
2,799,910 A * 7/1957 Weber ..... A44B 17/0082 24/681
2,947,049 A * 8/1960 Sidney ..... A44B 1/12 24/104
3,407,523 A * 10/1968 Winston ..... A01K 11/00 359/514
3,457,601 A * 7/1969 Prym ..... A44B 17/0005 24/104
4,272,869 A * 6/1981 Willner ..... A44B 5/00 24/108
4,597,206 A * 7/1986 Benson ..... A44C 3/001 24/103
4,604,819 A * 8/1986 Grey ..... A44C 3/004 40/1.5
4,793,155 A * 12/1988 Law ..... A44B 1/123 24/113 R
4,926,527 A * 5/1990 Sekiguchi ..... A44B 1/04 24/104
5,490,309 A * 2/1996 Velasquez ..... A41B 11/002 24/102 SL
5,511,289 A * 4/1996 Melia ..... A44B 6/00 24/459
5,655,271 A * 8/1997 Maxwell-Trumble ..... A44C 3/001 24/113 MP
5,687,494 A * 11/1997 Laurent ..... A44C 3/001 40/1.6
5,926,920 A * 7/1999 Denison ..... A44C 3/001 24/13
5,933,929 A * 8/1999 Kawakami ..... A44B 17/0035 24/324
5,974,590 A * 11/1999 Stubbs ..... A41B 11/002 2/239
6,170,131 B1 * 1/2001 Shin ..... A41F 1/002 24/303
6,199,247 B1 * 3/2001 Tsai ..... A47K 10/14 24/343
6,295,703 B1 * 10/2001 Adams ..... A41F 1/00 224/194
7,150,081 B2 * 12/2006 Juan ..... A41B 11/002 2/239
7,784,158 B2 * 8/2010 Doyle ..... A45F 5/02 24/114.12
8,141,211 B2 * 3/2012 Weyer ..... A44B 15/005 24/104
8,327,510 B2 * 12/2012 Schlesinger ..... A41F 17/02 2/269
8,490,257 B2 * 7/2013 Cameron ..... A44B 1/04 24/104
8,522,404 B2 * 9/2013 Matei ..... A44B 1/28 24/104
8,590,185 B1 * 11/2013 Jardine ..... G09F 21/02 24/104
8,695,170 B2 * 4/2014 Honeycutt ..... A44C 15/003 24/3.1
8,752,252 B2 * 6/2014 Ninomiya ..... H01F 7/0263 24/303
8,875,542 B2 * 11/2014 Severs ..... A44C 17/0208 24/303
8,991,006 B2 * 3/2015 Masanek, Jr. ..... B60N 3/044 16/21
9,131,739 B1 * 9/2015 Sjoquist ..... A41F 1/002
9,273,707 B2 * 3/2016 Lee ..... F16B 3/00
9,345,433 B1 * 5/2016 Shinozuka ..... A61B 5/1115
9,516,931 B2 * 12/2016 Mencagli ..... A44B 1/32
9,521,869 B2 * 12/2016 Weiss ..... A41D 13/015
9,568,144 B2 * 2/2017 Pernu ..... F16M 11/041
2003/0014844 A1 * 1/2003 Splane, Jr. ..... A45F 5/02 24/3.1
2007/0157494 A1 * 7/2007 Barcikowski ..... A44C 3/001 40/1.5
2009/0049666 A1 * 2/2009 Weyer ..... A44B 15/005 24/633
2011/0219587 A1 * 9/2011 Nizan ..... A41D 27/08 24/303
2011/0252548 A1 * 10/2011 Weiss ..... A41D 13/015 2/455
2014/0123361 A1 * 5/2014 Gudalis ..... A41D 13/0156 2/22
2016/0135550 A1 * 5/2016 Drage ..... A44B 17/0076 24/453

* cited by examiner

INTERCHANGEABLE FABRIC ACCESSORY AND METHOD OF USE

FIELD OF THE INVENTION

The present invention relates generally to display accessories for removable attachment to clothing garments. More particularly, the present invention relates to an accessory with an attachment section and an interchangeable section.

BACKGROUND OF THE INVENTION

In the art of garment accessories, there are typically found devices which pin to and therefore puncture the fabric surface of the given garment. Such devices are inherently damaging to any given clothing garment. For example, a common broach or tie-pin can cause loosening of the fabric fibers. Further, after repetitive attachment and removal, such common devices can cause excessive wear and tear of the garment. A variety of clothing accessory devices exist which avoid puncture of the garment.

One such prior device includes a clothing accessory disclosed U.S. Pat. No. 5,655,271 to Maxwell-Trumble et al. that provides a molded plastic plate and a molded plastic ring. The periphery of the plate is provided with a first engagement surface and the interior of the ring is provided with a second engagement surface. The relative dimensions of the plate and the ring are chosen such that the fabric of an article of clothing can be engaged between the first and second engagement surfaces. More specifically, when the ring is placed on one side of a fabric and the plate is placed on the other side of a fabric, the plate and ring may be pressed together so that the plate is frictionally engaged inside the ring by the fabric of the clothing. The engagement surfaces are V-shaped such that one of the surfaces is a concave V-shaped groove and the other is a convex V-shaped edge. This device also includes providing a peripheral lip on the plate which extends substantially orthogonal to one side surface of the plate to define an image receiving area. A photograph, hologram, or other decorative indicia is attached to the plate by providing the indicia on a material which is attached to the plate with an adhesive such as by a self-adhesive, peel and stick material. One limitation of this prior art device is that the molded plastic plate requires a layer of clothing in order to be frictionally engaged inside the molded plastic ring. In other words, the plate and ring cannot be assembled together unitarily without the intervening fabric of the clothing.

Another such prior device related to clothing accessories is disclosed in U.S. Pat. No. 5,926,920 to Denison whereby a snap-in adapter system includes an interior piece having a circular interior face and a short cylindrical side wall forming a cylindrical recess, the recess having an interior diameter. The system also includes an exterior piece. The exterior piece has a circular exterior face with a diameter slightly less than that of the diameter of the recess of the interior piece forming a uniform gap there between. In this manner, Denison requires an intervening layer of fabric in such gap so as to retain the exterior and interior pieces together. The exterior piece also has a cylindrical projection. The interior and exterior pieces mate in order to hold fabric of clothing there between. Also provided is an attachment means which is shown to be either a tube or a bore. The tube or bore forms a mount whereby only jewelry, name tags, or similar clothing accessory having a pin may be mounted. Because such pin mounts within either the tube or bore of the adapter system, no clothing fabric is pierced by the pin.

Another such prior device related to clothing accessories is disclosed in U.S. Published Patent Application 2008/0250677 to O'Leary. This device relates to an item of clothing with an accessory such as a badge for attachment to clothing and suitable accessories for the purpose. The badge provides a plastic main body portion having a printable surface on at least one side. An attachment portion is provided having a recess in which the main body portion can fit snugly together with a panel of a garment. The garment is trapped between the main body portion and the attachment portion when they are fitted from opposed sides of the garment panel. The fit between the main body portion and the attachment portion, once the garment panel is trapped there between, is sufficiently tight to hold the portions together in engagement. Alternatively, magnetic portions may be used to ensure sufficient hold on the garment is maintained. Throughout, the badge is provided with artwork to cooperate with the artwork on the garment such that the use of different badges, different placements or different sides of two sided badges can alter the overall synergistic effect. Similar to Maxwell-Trumble, the non-magnetic main body portion and attachment portion cannot be assembled together unitarily without the intervening fabric of the clothing.

Another such prior device related to clothing accessories is disclosed in U.S. Pat. No. 5,511,289 to Melia showing a buckle for use with t-shirts, hair or other similar flexible substrates. The buckle is comprised of a base portion having openings through which the tail of the t-shirt is inserted and a cover which removably locks onto the base, thereby securing the buckle to the t-shirt. The base is provided with two openings separated by a bar and surrounded by an inwardly facing ridge. The ridge is engagable with a series of outwardly facing grooves provided on the cover in order to releasably lock the buckle to t-shirts of various thicknesses. Because this device only includes the openings through which the flexible substrate is placed, requisite bunching and wrinkling of the substrate occurs. This precludes smooth placement on a flat fabric portion of clothing.

It is, therefore, desirable to at least provide a clothing accessory which can be assembled completely yet remain removable with regard to attachment to clothing garments.

SUMMARY OF THE INVENTION

It is an object of the present invention to obviate or mitigate at least one disadvantage of previous clothing accessory devices.

The present invention provides a clothing accessory that can be completely assembled while remaining removable with regard to attachment to clothing garments. Moreover, the present invention includes an attachment section for securing the overall device to a garment fabric and an interchangeable section for selectively attaching a unique visual element. The unique visual element may be a decorative component or components that are collectable, customizable, or otherwise interchangeable.

In a first aspect, the present invention provides an interchangeable accessory including: an attachment section formed by concentric rings connectable by ridges placed there between, the ridges capable of retaining fabric of a garment between the concentric rings; and an interchangeable section removably affixed to the attachment section, the interchangeable section including a convex surface extending outwards from a surface of the fabric of the garment, the convex surface including a unique adornment.

In another aspect, there is provided an interchangeable accessory including: an attachment section formed by an inner peripheral ring having a plurality of outer ridges interspersed along an outer circumference thereof and a plurality of inner ridges interspersed along an inner circumference thereof, an outer peripheral ring having a concavity located at an inner-edge surface thereof, a gap between the inner-edge surface of the outer peripheral ring and an outer-edge surface of the inner peripheral ring, and the plurality of outer ridges forming an interference fit within the concavity upon snap fitting of the inner-edge surface of the outer peripheral ring against the outer-edge surface of the inner peripheral ring; and an interchangeable section formed by a plug having an outside peripheral edge and an inside peripheral edge which edges together form a cylindrical extension from a circular surface of the plug, the inside peripheral edge is configured to snap-fit onto the inner ridges formed on the inner peripheral ring, and a cap including an inner circumferential tab having an inner periphery dimensioned smaller than the outer peripheral edge of the plug such that the cap is connectable to the plug in a removable manner.

In a further aspect, the present invention provides a method of interchangeably accessorizing, the method including: capturing a fabric of a garment within an attachment section formed by concentric rings connectable by ridges placed there between, the ridges retaining the fabric between the concentric rings; and affixing, in a removable manner, an interchangeable section to the attachment section, the interchangeable section including a convex surface extending outwards from a surface of the fabric of the garment, the convex surface including a unique adornment.

In still a further aspect, the present invention provides a method of interchangeably accessorizing, the method including: capturing an attachment section formed by an inner peripheral ring having a plurality of outer ridges interspersed along an outer circumference thereof and a plurality of inner ridges interspersed along an inner circumference thereof, an outer peripheral ring having a concavity located at an inner-edge surface thereof, a gap between the inner-edge surface of the outer peripheral ring and an outer-edge surface of the inner peripheral ring, and the plurality of outer ridges forming an interference fit within the concavity upon snap fitting of the inner-edge surface of the outer peripheral ring against the outer-edge surface of the inner peripheral ring; and affixing to the attachment section an interchangeable section, the interchangeable section formed by a plug having an outside peripheral edge and an inside peripheral edge which edges together form a cylindrical extension from a circular surface of the plug, the inside peripheral edge being configured to snap-fit onto the inner ridges formed on the inner peripheral ring, and a cap including an inner circumferential tab having an inner periphery dimensioned smaller than the outer peripheral edge of the plug such that the cap is connectable to the plug in a removable manner.

In yet another aspect, the present invention provides an interchangeable accessory including: an attachment section formed by an inner peripheral ring having a plurality of outer ridges interspersed along an outer circumference thereof and a plurality of inner ridges interspersed along an inner circumference thereof, an outer peripheral ring having a concavity located at an inner-edge surface thereof, a gap between the inner-edge surface of the outer peripheral ring and an outer-edge surface of the inner peripheral ring, the gap existing only in areas devoid of the outer ridges, and the plurality of outer ridges forming an interference fit within the concavity upon snap fitting of the inner-edge surface of the outer peripheral ring against the outer-edge surface of the inner peripheral ring; and an interchangeable section formed by a plug having an outside peripheral edge and an inside peripheral edge which edges together form a cylindrical extension from a circular surface of the plug, the inside peripheral edge is configured to snap-fit onto the inner ridges formed on the inner peripheral ring, and a cap including an inner circumferential tab having an inner periphery dimensioned smaller than the outer peripheral edge of the plug such that the cap is connectable to the plug in a removable manner.

In yet still another aspect, the present invention provides a method of interchangeably accessorizing, the method including: capturing an attachment section formed by an inner peripheral ring having a plurality of outer ridges interspersed along an outer circumference thereof and a plurality of inner ridges interspersed along an inner circumference thereof, an outer peripheral ring having a concavity located at an inner-edge surface thereof, a gap between the inner-edge surface of the outer peripheral ring and an outer-edge surface of the inner peripheral ring, the gap existing only in areas devoid of the outer ridges, and the plurality of outer ridges forming an interference fit within the concavity upon snap fitting of the inner-edge surface of the outer peripheral ring against the outer-edge surface of the inner peripheral ring; and affixing to the attachment section an interchangeable section, the interchangeable section formed by a plug having an outside peripheral edge and an inside peripheral edge which edges together form a cylindrical extension from a circular surface of the plug, the inside peripheral edge being configured to snap-fit onto the inner ridges formed on the inner peripheral ring, and a cap including an inner circumferential tab having an inner periphery dimensioned smaller than the outer peripheral edge of the plug such that the cap is connectable to the plug in a removable manner.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures.

DETAILED DESCRIPTION

Figure 1:
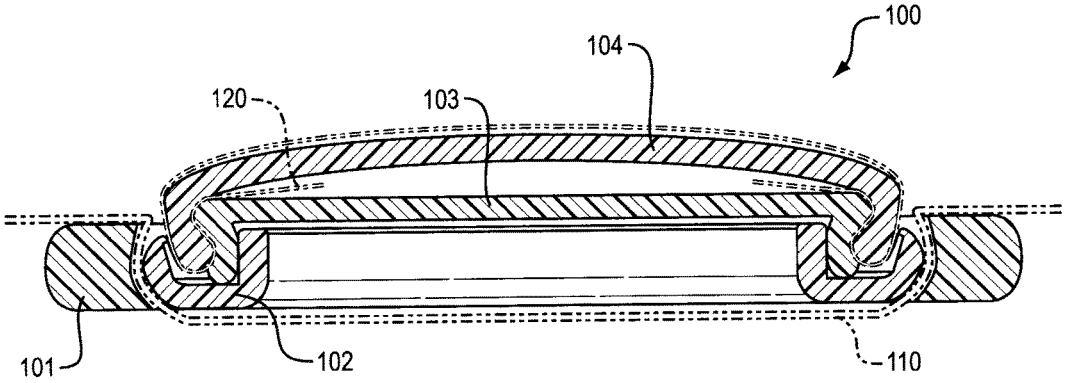
FIG. 1 is a cross section view of an interchangeable fabric accessory in accordance with the present invention.
Figure 2:
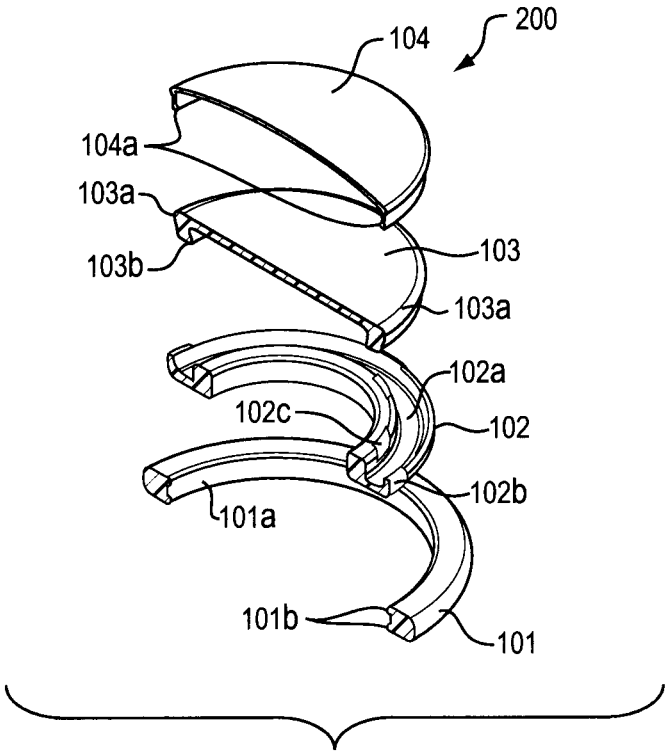
FIG. 2 is an exploded cross section view of the interchangeable fabric accessory in accordance with the present invention.
Figure 3:
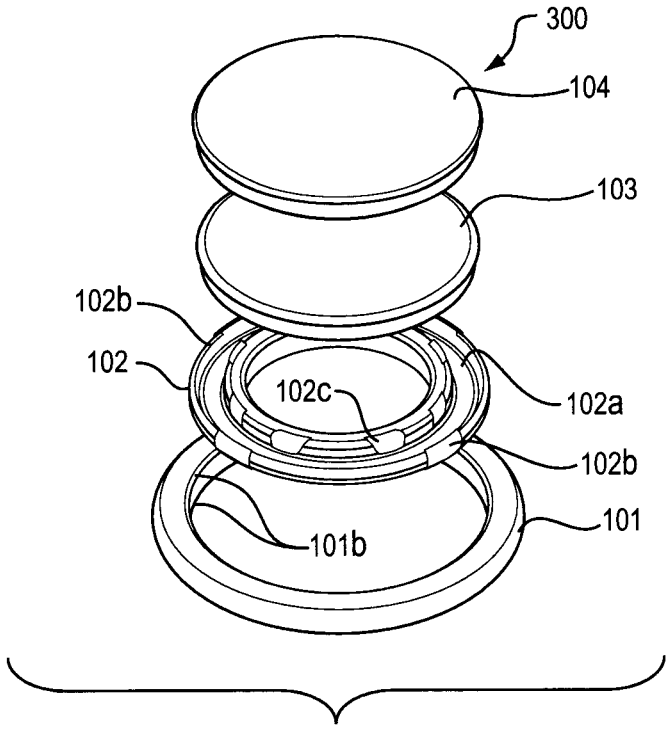
FIG. 3 is an exploded three dimensional view of the interchangeable fabric accessory in accordance with the present invention.

Generally, the present invention provides an interchangeable accessory device and method for its use. In this manner, the inventive device is configured to display accessories for removable attachment to clothing garments. With detailed reference to the figures, the inventive device can be seen as accessory with two primary components being an attachment section and an interchangeable section. With reference to FIGS. 1-3, there is shown one embodiment of the present invention. Such embodiment is illustrative of the basic inventive concepts of the present invention and should not be considered limiting, but rather it should be readily understood that variations may be possible without straying from the intended scope of the invention.

With specific reference to FIG. 1, there is shown a cross sectional view of an interchangeable fabric accessory in accordance with one embodiment of the present invention. Here, an attachment section formed by an outer peripheral ring 101 and an inner peripheral ring 102 are provided. This attachment section of rings 101 and 102 serve in the capacity of a base within a garment's fabric. This is accomplished by locking a section of the fabric surface between the rings 101 and 102. In the configuration shown, the outer peripheral ring 101 is situated on the underside (i.e., body-side) of the garment's fabric and the inner peripheral ring 102 is situated on the outside (i.e., external surface) of the garment's fabric.

FIG. 2 is an exploded cross section view of the interchangeable fabric accessory in accordance with the present invention. FIG. 3 is an exploded three dimensional view of the interchangeable fabric accessory in accordance with the present invention. With additional reference to these FIGS. 2 and 3, it is noted that the inner-edge surface of the outer peripheral ring 101 and the outer-edge surface of the inner peripheral ring 102 do not entirely compress the fabric there between. Rather, the fabric is held in place via outer ridges 102*b* which are shown spaced about the outer-edge surface of the inner peripheral ring 102 in FIGS. 2 and 3. It should further be noted that mating attachment of the rings 101 and 102 can occur with or without the presence of fabric there between. Moreover, the use of ridges allows for a wider range of materials in terms of the fabric and garments to which the invention is attachable. It should also be readily apparent that a gap is thereby formed where the outer ridges 102*b* do not exist. As well, there is no need for any specific gap size for any given fabric or garment material. This differs from prior art devices which include a gap that must be sized to an optimal garment width. In the instance of mating attachment of the rings 101 and 102 occurring without the presence of fabric there between, it should be readily apparent from the figures that outer ridges 102*b* snap-fit into the concavity 101*a* which forms the inner surface of the outer peripheral ring 101.

At a minimum, the inner peripheral ring 102 and its outer ridges 102*b* are formed from a resilient material such as, but not limited to, a flexible plastic. Moreover, the outer leading edge of the outer ridges 102*b* form an overall diameter of the inner peripheral ring 102 that is greater than the innermost leading edges of the concavity 101*a* of the outer peripheral ring 101. As suggested above, this means that in order for the outer ridges 102*b* to become seated into the concavity 101*a*, the outer ridges 102*b* will be slightly compressed inwards by the innermost leading edges 101*b* of the top of concavity 101*a* and thereby snap-fit into the concavity 101*a*. It should be readily apparent that the edges 101*b* are at both the top and bottom of the concavity 101*a* such that the outer peripheral ring 101 should be considered reversible.

While fabric located between rings 101 and 102 will assure a snug interference fit of the outer ridges 102*b* into the concavity 101*a* when a garment is present, the fact that the outer ridges 102*b* extend radially outwards into the concavity 101*a* and are retained by the top and bottom innermost leading edges 101*b* means that the rings 101 and 102 can be snap-fit together without any fabric situated there between. In typically operation, such snap-fit will normally occur by placing one side of the inner peripheral ring into a corresponding section of the concavity 101*a*. After one side is thus engaged, the user would then manually advance the remaining inner peripheral ring 102 into the remaining concavity 101*a* until the inner peripheral ring 102 is completely seated within the inner area of the outer peripheral ring 101 and thereby retained within the concavity 101*a*. The inner peripheral ring 102 also includes a channel 102*a* which accepts the interchangeable section as described further herein below.

With further reference to the figures, the second of the two primary components will now be described. The second primary component is an interchangeable section formed by a plug 103 and a cap 104, though variations in terms of the interchangeable section are possible without straying from the intended scope of the present invention. For example, the plug and cap could be considered as a unitary structure whereby the convexly curved outer surface would include, without limitation, some pre-stamped, painted, or adhesive decorative element or adornment.

In the embodiment shown in the instant figures, the plug 103 includes an outside peripheral edge 103*a* and an inside peripheral edge 103*b* which together form a cylindrical extension from a circular surface of the plug. These edges 103*a* and 103*b* are basically circumferential tabs or lip-type structures. The inside peripheral edge 103*b* is configured to snap-fit onto inner ridges 102*c* formed on the inner peripheral ring 102. These inner ridges 102*c* extend radially in the same general direction as the outer ridges 102*b* and are separated radially by way of the channel 102*a*. As shown, the outer ridges 102*b* and inner ridges 102*c* are interspersed circumferentially between one another on opposite sides of the channel.

The cap 104 is configured to snap-fit onto the plug 103. This is accomplished as shown by the provision of an inner circumferential tab 104*a* provided at an inner bottom edge of the cap 104. This tab 104*a* is basically a peripheral edge or lip-type structure similar to edges 103*a* and 103*b*. The inner periphery of the tab 104*a* is dimensionally smaller than the outer periphery of the outside peripheral edge 103*a* of the plug 103. Because of this dimensional difference, the tab 104*a* of the cap 104 can snap onto the edge 103*a* of the plug 103 in a manner similar to a typical compression ring. Likewise, removal of the cap 104 from the plug 103 could be accomplished by prying one from another at the mating lips of the tab 104*a* and edge 103*a*, a notch (not shown) could be provided in such instance. In a typical implementation however, it should be noted that the cap 104 and plug 103 may be affixed together in a more permanent manner such that prying them apart would be dissuaded by the manufacturer. In this manner, sales of plug/cap combinations having differing decorative elements or adornments would be therefore facilitated.

Such removability of the cap 104 and plug 103 from one another is a useful feature of the present invention. In this way, a swatch of fabric may be placed (i.e., overlaid) atop the cap 104 and secured by tucking such swatch under the cap and holding such swatch in place via the mating lips of the tab 104*a* and edge 103*a*. Moreover, the cap 104 may be fabricated from a clear plastic material such that the swatch of fabric can be placed atop the plug 103 and overlapped at the edge 103*a* yet still secured (i.e., underlaid) in place under the clear cap 104 via the mating lips of the tab 104*a* and edge 103*a*. In this way, the swatch of fabric can be any emblem, written article such as a name tag, collectible artistic piece, or any similar item capable of placement on a fabric swatch. It should also be further understood that the removability aspect in regards to the swatch allows for interchangeability by a user of the overlaid or underlaid swatch.

It should further be understood that the exposed surfaces of the plug 103 and cap 104 to which the swatch is either overlaid or underlaid are concave such that a three-dimensional aspect is provided. This aids in projecting the item to be viewed (i.e., emblem, written article such as a name tag, collectible artistic piece . . . etc) above and beyond the surface of the garment's fabric. This feature of the present invention provides improved visibility and desirable aesthetics.

While the constituent parts of the present invention have been discussed as being fabricated from a flexible material such as, but not limited to, plastic, it should be readily apparent that some parts may be made flexible while others do not require flexibility. For example, the outer peripheral ring 101 may be provided as a non-flexible metallic material. As well, the specific shapes of the constituent parts may allow for various other flexible, yet non-plastic (i.e., non-polymer), materials without straying from the intended scope of the present invention.

Once the entire interchangeable section formed by the plug 103, cap 104, and affixed swatch (either overlaid or underlaid) is assembled, the combined elements are configured to be affixed to the attachment section as shown in FIG. 1. Here, the plug 103 and cap 104 are shown together whereby their combined peripheral edge fits firmly within the channel 102*a* of the inner peripheral ring 102. In this manner and as previously mentioned above, the inner ridges 102*c* provide an interference snap-fit with the inside peripheral edge 103*b* formed on the inner peripheral ring 102 so as to retain the interchangeable section to the attachment section.

Effectively, this provides another level of interchangeability such that the entire interchangeable section formed by the plug 103, the cap 104, and the affixed swatch is removable from the attachment section. In this way, the attachment section (i.e., elements 101 and 102) can be affixed once to a garment's fabric and the user can then remove and install different interchangeable sections (i.e., duplicated elements 103, 104, and a swatch). Multiple interchangeable sections could therefore be manufactured and provided separately for a single attachment section. Mixing and matching different interchangeable sections may therefore also form the basis for collectible emblems, badges, swatches or any other component suitably installed or otherwise attached to the interchangeable sections.

Although one particular configuration has been shown and discussed, it should be readily apparent that other configurations may be possible within the intended scope of the present invention.

More specifically, the interchangeable section could be provided in the form of a disk and coupling ring. The disk would be reversible thus having a first decorative emblem or the like on one side and a different second one on the reverse side. The disk itself could be snap-fit into a ring which then subsequently mates in the manner described above to the attachment section.

Another variation may include a single disk upon which a swatch is placed which together form the interchangeable section. The swatch-on-disk would be replaceable and be snap-fit into a ring which then subsequently mates in the manner described above to the attachment section.

Yet another variation may include a disk having a clear cover between which a user may insert one's own image. The image-on-disk would be replaceable and be snap-fit into a ring which then subsequently mates in the manner described above to the attachment section.

Yet still another variation may include a threaded disk having a retaining ring with mated threads where the retaining ring serves to retain a clear Mylar cover atop a name-tag, photo, or the like. Thus, a user may thread and unthread the threaded disk and retaining ring to remove, replace, or otherwise customize the element retained under the clear Mylar cover. A slot under the threaded disk can be provided to facilitate threading and unthreading. The image-on-threaded-disk would be replaceable and be snap-fit into a ring which then subsequently mates in the manner described above to the attachment section.

Still another variation may include a hollowed disk having a clear cover between which an electronic device may be inserted. A variety of such electronic devices may be provided and customizable. The cover may be threadingly (and thus removably) mounted, or may be glued or otherwise permanently affixed to preclude user tampering. The electronics-encased-on-disk would be replaceable and be snap-fit into a ring which then subsequently mates in the manner described above to the attachment section.

Yet still another variation may include a disk having a visible surface opposite a mounting side. The mounting side may have indents, apertures, or slots that may adhere, affix, or otherwise connect to a ring. The indents, apertures, or slots can be used to attach any number of name-tag, photo, decorative item, or the like. The decoration-on-disk would be replaceable and be snap-fit into a ring which then subsequently mates in the manner described above to the attachment section.

Furthermore, it should be understood that the attachment section could include an eyelet connector. Such eyelet connector may be affixed to an outer edge of the outer peripheral ring, or alternatively the inner perhipheral ring. In this manner, the attachment section could be alternatively connected to a keychain, link, or mechanical connection via the eyelet connector instead of being snap-fit onto fabric of a garment. Thus, the collectability and overall tradability of the device incorporating the invention would be enhanced by allowing a user to have a different mode of wearing or otherwise displaying the same structure.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. An interchangeable accessory comprising:

an attachment section to capture a fabric when attaching the accessory to the fabric, without piercing the fabric, the attachment section comprising an outer peripheral ring and an inner peripheral ring;

said outer peripheral ring and said inner peripheral ring connectable by an interference fit between an outer surface of the inner peripheral ring and an inner surface of the outer peripheral ring via a plurality of circumferentially spaced ridges, the plurality of circumferentially spaced ridges permitting the interference fit when the fabric is captured between the outer and inner peripheral rings, the plurality of circumferentially spaced ridges also permitting the interference fit between the outer and inner peripheral rings without the fabric being present, and the plurality of circumferentially spaced ridges forming a plurality of gaps between the outer and inner peripheral rings to accommodate the fabric when present; and an interchangeable section removably attached to said inner peripheral ring, the interchangeable section comprising:

a plug having an outside peripheral edge and an inside peripheral edge which edges together form a cylindrical extension from a circular surface of said plug, said inside peripheral edge is configured to snap-fit onto a plurality of circumferentially spaced inner ridges formed on said inner peripheral ring; and a cap including an inner circumferential tab having an inner periphery dimensioned smaller than said outer peripheral edge of said plug such that said cap is connectable to said plug in a removable manner.

2. A method of interchangeably accessorizing, said method comprising:

capturing a fabric within an attachment section without piercing the fabric, the attachment section comprising an outer peripheral ring on a first surface of a fabric and an inner peripheral ring on a second surface of said fabric, and said outer peripheral ring and said inner peripheral ring connectable by an interference fit with said fabric positioned in between by an outer surface of the inner peripheral ring and an inner surface of the outer peripheral ring holding the fabric in place via a plurality of circumferentially spaced ridges, the plurality of circumferentially spaced ridges permitting the interference fit when the fabric is captured between the outer and inner peripheral rings, the plurality of circumferentially spaced ridges also permitting the interference fit between the outer and inner peripheral rings without the fabric being present, and the plurality of circumferentially spaced ridges forming a plurality of gaps between the outer and inner peripheral rings to accommodate the fabric; and attaching, in a removable manner, an interchangeable section to said inner peripheral ring, said interchangeable section including a surface extending outwards from said second surface of said fabric, wherein the interchangeable section is formed by:

a plug having an outside peripheral edge and an inside peripheral edge which edges together form a cylindrical extension from a circular surface of said plug, said inside peripheral edge is configured to snap-fit onto a plurality of circumferentially spaced inner ridges formed on said inner peripheral ring; and a cap including an inner circumferential tab having an inner periphery dimensioned smaller than said outer peripheral edge of said plug such that said cap is connectable to said plug in a removable manner.

3. The interchangeable accessory of claim 1, wherein the inner surface of the outer peripheral ring comprises a concavity that interfaces with the plurality of circumferentially spaced ridges to form the interference fit.

4. The interchangeable accessory of claim 3, wherein the inner peripheral ring further comprises a plurality of circumferentially spaced inner ridges to snap fit with the interchangeable section.

5. The interchangeable accessory of claim 1, wherein the plurality of circumferentially spaced ridges form the interference fit upon snap fitting of the inner surface of the outer peripheral ring against the outer surface of the inner peripheral ring.

6. The interchangeable accessory of claim 5, wherein the snap fitting comprises compressing the plurality of circumferentially spaced ridges inwards by the inner surface of the outer peripheral ring.

7. The interchangeable accessory of claim 6, wherein the inner surface of the outer peripheral ring comprises a concavity into which the plurality of circumferentially spaced ridges are seated upon forming the interference fit.

8. The method of claim 2, wherein the fabric is captured between the plurality of circumferentially spaced ridges and a concavity of the inner surface of the outer peripheral ring.

9. The method of claim 8, wherein the inner peripheral ring further comprises a plurality of circumferentially spaced inner ridges to snap fit with the interchangeable section during the attaching.

10. The method of claim 2, wherein the plurality of circumferentially spaced ridges form the interference fit upon snap fitting of the inner surface of the outer peripheral ring against the outer surface of the inner peripheral ring with the fabric captured between the inner and outer peripheral rings.

11. The method of claim 10, wherein the snap fitting comprises compressing the plurality of circumferentially spaced ridges inwards by the inner surface of the outer peripheral ring.

12. The method of claim 11, wherein the inner surface of the outer peripheral ring comprises a concavity into which the plurality of circumferentially spaced ridges are seated upon forming the interference fit.

* * * * *